United States Patent [19]

Balchunas

[11] 4,415,796

[45] Nov. 15, 1983

[54] ELECTRIC IRON WITH UNITARY THERMOSTAT AND OVERTEMPERATURE CONTROL ASSEMBLY

[75] Inventor: Charles A. Balchunas, Bethany, Conn.

[73] Assignee: General Electric Company, New York, N.Y.

[21] Appl. No.: 260,321

[22] Filed: May 4, 1981

[51] Int. Cl.[3] ..... H05B 1/02; H01H 37/76; G03D 23/08

[52] U.S. Cl. ..... 219/253; 38/77.7; 38/82; 219/517; 337/3; 337/404; 337/405; 337/407

[58] Field of Search ..... 219/245-259, 219/517; 337/401-416, 375, 299, 3, 4; 38/77.1, 77.7, 82

[56] References Cited

U.S. PATENT DOCUMENTS

| | | | |
|---|---|---|---|
| 797,713 | 8/1905 | Backman . | |
| 1,309,233 | 7/1919 | Akin . | |
| 1,386,923 | 8/1921 | Capper . | |
| 1,986,507 | 1/1935 | Knight | 337/416 X |
| 2,873,347 | 2/1959 | Boggs . | |
| 3,043,937 | 7/1962 | Milton et al. | 337/405 |
| 3,611,235 | 10/1971 | Rose | 337/4 |
| 3,796,981 | 3/1974 | Poitras | 337/407 X |
| 3,827,014 | 7/1974 | Wehl | 337/407 |
| 4,255,736 | 3/1981 | Kelley et al. | 337/407 |
| 4,307,370 | 12/1981 | Hullweck | 337/407 X |
| 4,313,047 | 1/1982 | Cox et al. | 337/402 X |
| 4,319,126 | 3/1982 | Lujic | 219/517 X |
| 4,360,725 | 11/1982 | Eeckhout | 219/517 |

FOREIGN PATENT DOCUMENTS

| | | | |
|---|---|---|---|
| 604189 | 8/1960 | Canada | 219/253 |
| 2339674 | 2/1975 | Fed. Rep. of Germany | 219/253 |

*Primary Examiner*—A. Bartis

*Attorney, Agent, or Firm*—John F. Cullen; George R. Powers; Leonard J. Platt

[57] ABSTRACT

An adjustable stacked thermostat assembly, particularly for use in an electric appliance, such as an electric steam iron, includes a lower bimetallic heat deformable blade, an intermediate stiff conductive spring blade carrying a electrical contact and connected to a first electric terminal and an upper less stiff conductive spring blade carrying a cooperating contact and connected to a second terminal, with all of the blades being supported, secured and spaced apart at one end by interposed insulators. In operation movement of the deformable blade is transmitted to the upper blade to make and break the contacts to control heat to the appliance controlled by the thermostat. An overtemperature control is provided as part of and adjacent the stacked assembly and includes a downwardly biased conductive bus bar adjacent to the heat deformable blade and secured to the first terminal, a conducting finger connected to the second terminal through the contacts and projecting from the stack at right angles to and overlapping the bus bar, and an insulator between and separating the finger and bar. A fusible pellet carried by the insulator cooperates with the finger and bar to establish an electric circuit therebetween by either bridging the space between the bar and finger to connect them electrically in series through the pellet or by biasing the bar into direct electrical contact with the finger. Upon melting of the pellet, the downwardly biased bar drops and abuts a stop on insulator to break the circuit established between the bar and finger.

10 Claims, 7 Drawing Figures

ELECTRIC IRON WITH UNITARY THERMOSTAT AND OVERTEMPERATURE CONTROL ASSEMBLY

BACKGROUND OF THE INVENTION

1. Field of the Invention

The invention pertains to a specific stacked adjustable thermostat assembly used alone or preferably on an iron soleplate mount and integrally incorporates therewith an overtemperature control structure closely adjacent the thermostat as an integral part so the overtemperature control is subject to the same heat as the thermostat in a unitary assembly that uses fewer parts with faster and more accurate heat response.

2. Description of the Prior Art

Appliances, such as irons, provide a mount for a temperature controlling variably adjustable thermostat where the mount comprises a boss on the soleplate creating a heat sink or a collecting conductor for the thermostat which is mounted in close contact on the boss reacting to adjustably set temperatures. Generally, in an iron, the thermostat is mounted centrally or in the forward portion of the soleplate at the hottest part to react accordingly. It is known to use an overtemperature control in series with the thermostat to protect the iron against overheating if the thermostat malfunctions. Such an arrangement is shown in U.S. Pat. No. 3,665,152 of common assignment showing a separate overtemperature control located at the rear of the iron removed from the thermostat.

Recently developments have produced lightweight plastic irons requiring rearrangement of otherwise conventional thermostats and combining many functions in the molded plastic that eliminates many parts of previous metallic irons. Generally, a forward thermostat location is advantageous in irons which provide extra steam capacity whereby an extra slug of water is pumped into a steam boiler, usually a separate chamber, to generate an extra surge of steam which is fed into the distribution system to exit soleplate ports as extra capacity steam. Many types of surge steam irons exist and a typical one is U.S. Pat. No. 3,919,793 of common assignment. Also, the general stacked thermostat is known and used in many appliances such as irons, cookers, and other appliances where temperature is automatically set usually by a bimetal thermostat. The thermostat controls the heating element to maintain the selected temperature. For such an iron, a typical adjustable thermostat controls the heating element and is simple, inexpensive, and reliable, using fewer parts easier assembled as shown in U.S. Pat. No. 4,259,655 of common assignment. With such thermostat it is desired to provide a more efficient overtemperature control that may be used in an iron requiring fewer parts and faster and more accurate response by generally exposing the overtemperature control to the same temperature as the thermostat and integrating it as part of the thermostat.

SUMMARY OF THE INVENTION

The present invention is directed to a stacked adjustable thermostat assembly alone and in combination with an electric steam iron with a water tank, steam generating soleplate with ports, a pump connected to the tank for manual operation and a mount on the soleplate for close support of the heat-responsive thermostat assembly to control the temperature of the soleplate. In this structure, an improved stacked variably adjustable thermostat assembly includes a lower heat deformable blade, a conductive intermediate stiff spring blade with one electric terminal, a conductive upper less stiff spring blade with a separate terminal, with all the blades being supported, secured, and spaced apart on one end by interposed insulators in a sandwich-like construction with electrical contacts being provided on the conductive blades and means to transmit movement of the heat deformable blade to the upper blade to make and break an electric circuit controlling the soleplate temperature. A single structural support bracket ties all the members together in a stacked assembly. Forming part of this unitary assembly is an overtemperature control means as part of and adjacent the stacked assembly having a downwardly biased and horizontally extending conductive bus bar parallel to the heat deformable blade and secured to said one electric terminal. A conducting finger is connected to said separate terminal through said electrical contacts and projects from the adjacent stack substantially at right angles to and overlapping the bus bar. A U-shaped insulator with spaced stop means is disposed between and separating the finger and bar and a fusible pellet carried by the insulator biases the finger and bar in electrical contact in one form (FIGS. 2 and 3) through the pellet and, in an alternate form (FIGS. 5 and 6) the pellet biases the finger and bar directly into contact with each other leaving the pellet out of the circuit. Spaced stop means are provided on the insulator and disposed to limit downward bar movement such that the pellet responds to the same heat as the deformable blade which is in series in the assembly so that when the pellet melts the downwardly biased bar drops against the stops to break the circuit between the bar and finger for fast and accurate heat response in the same environment as the thermostat. Thus, the main object of the invention is to disclose a unique adjustable thermostat integral overtemperature control assembly in two forms especially useful with an electric iron.

DESCRIPTION OF THE PREFERRED EMBODIMENT

The present invention is described in connection with a lightweight plastic iron as especially applicable to such use although the thermostat assembly per se has other uses than on irons. The invention represents an improved version of an adjustable thermostat assembly in U.S. Pat. No. 4,259,655 of common assignment and the iron/thermostat description is generally repeated herein. In addition, it uses the concept of an overtemperature control of U.S. Pat. No. 3,665,152 of common assignment in an improved integrated form.

Figure 1:
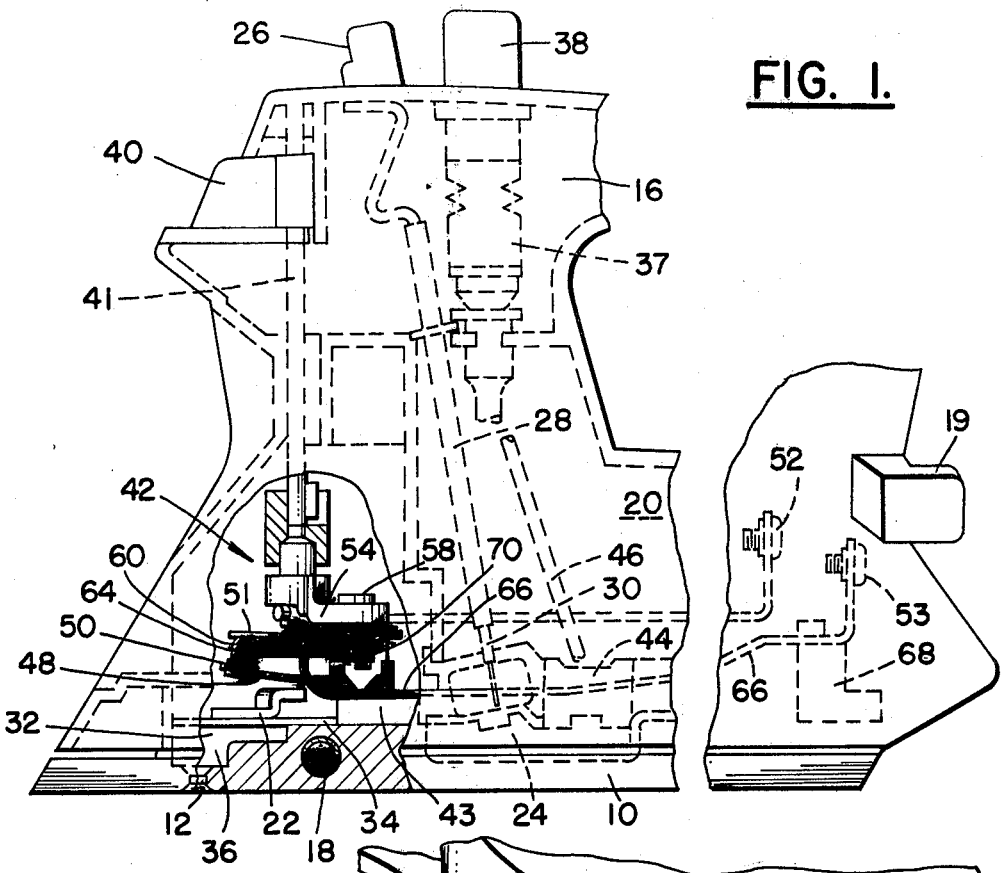
FIG. 1 is a partial elevation of a typical surge steam iron partly broken away to show the location and arrangement of the invention.

Referring to FIG. 1 there is shown an electric steam iron generally known in applicant's assignee's line of steam irons including a soleplate 10 with a plurality of steam ports 12 and an outer shell 14 connected with handle 16 in known fashion. Soleplate 10 is cast aluminum with electric heating element 18 therein for uniform heat distribution when the iron is plugged in. A suitable support 19 stores the iron on its heel when inoperative. The iron includes means for generating steam with water tank 20 as part of a single plastic housing secured by L-shaped fastener 22. For steam, soleplate 10 has a steam generator 24 into which, under control of button 26 and guided valve stem 28 movable between an on/off position, water drips from tank 20 onto hot soleplate 10 through metering water valve 30, the resulting steam flowing through distributing passages 32 under coverplate 34 and out ports 12 onto the fabric being ironed. As shown, an additional surge is provided by injecting water into separate forward surge generator 36 by bellows pump 37 manually operated by separate control button 38. Variable external temperature adjustment means 40, high on the front of handle 16, connects with forward vertical control rod 41 in the handle to operate variably adjustable thermostat at 42 of the known stack type which is snugly mounted on soleplate boss 43 formed as part of the iron soleplate casting for a good heat sink contact. All of the structure thus far described is conventional and fully shown in U.S. Pat. No. 4,259,655 supra.

As the iron shown is a self-cleaning iron of the type of U.S. Pat. No. 3,747,241 of common assignment, it has means for suddenly and completely dumping tank 20 onto the hot soleplate through a large opening that preferably, though not necessarily, is spaced and separate from the usual water valve 30. Controlling this large opening is dumper valve 44 disposed in the bottom of tank 20 and operated through rod 46 by a button, not shown, on the side of the iron to quickly empty the tank onto the soleplate where the combination of hot water and steam suddenly created purges the internal passages, tank, and soleplate ports of lint and mineral deposits.

An improved stacked thermostat assembly is provided for the iron for better heat response and is fully disclosed and claimed in said U.S. Pat. No. 4,259,655 supra. Such thermostat assembly design reduces the parts normally required using a single integral bracket that performs multiple functions providing easy assembly, accurate adjustment, and a fixed locator of all structural parts. The thermostat includes a lower heat deformable or temperature responsive bimetal blade 48, a relatively stiff but flexible conductive intermediate spring blade 50 with a connection in the stack leading out to one electric terminal 53, and a less stiff upper spring blade 51 leading out to a separate terminal 52 to which the power cord attaches. The three blades 48, 50, and 51 are supported and secured together at one end in a sandwich configuration along with integral support bracket 54 parallel to and above flexible blade 51. Thus, the blades, support bracket, etc. are spaced apart and electrically insulated at the one (right) end by a conventional central insulating tube not shown and interposed ceramic insulators 56 to electrically separate the parts with a suitable fastener 58 to clamp the stacked assembly together at one end as a mounting post securing the assembly snugly to soleplate boss 43.

The spring blades 50 and 51 are provided respectively with facing electrical contacts 60 which, when closed, permit current to flow through heating element 18 of the iron and when open, as shown, breaks the current flow. On the free end of bimetal blade 48 is insulator 64 such that when bimetal 48 is heated by the medium (soleplate) whose temperature it senses, it bends upwardly towards blade 51 such that 64 presses against blade 51 to open contacts 60 as shown in FIG. 1 to cut off power to the iron. The support bracket 54 carries the entire stacked assembly as a unitary one-piece arrangement performing multiple functions. The thermostat structure thus far described is completely shown and claimed in U.S. Pat. No. 4,259,655 supra.

Figure 2:
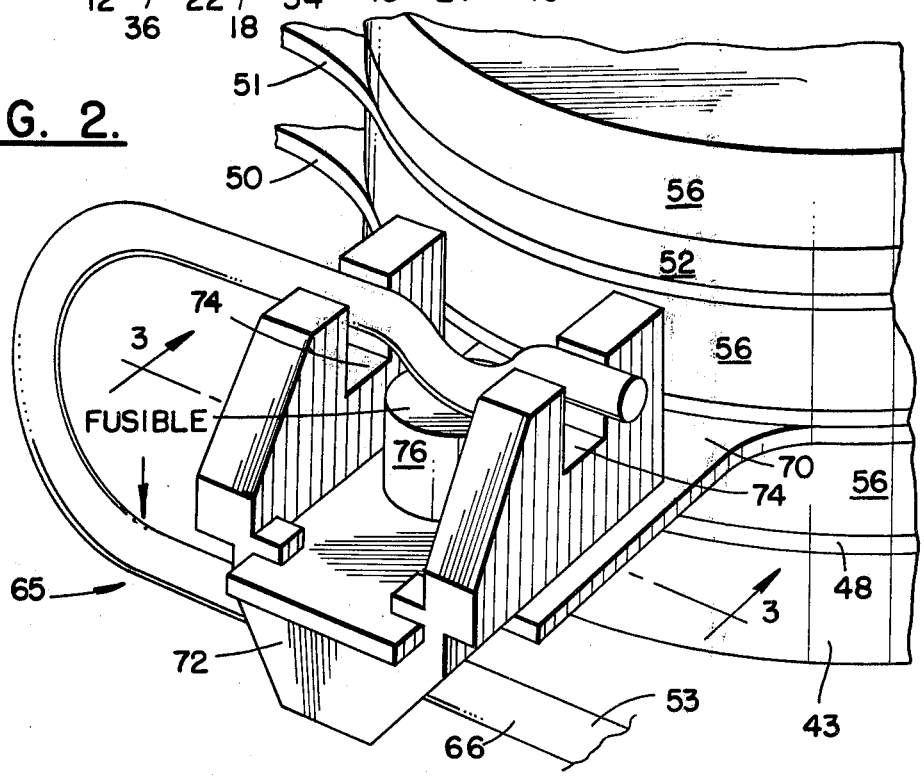
FIG. 2 is an enlarged perspective of one form of the overtemperature control.
Figure 3:
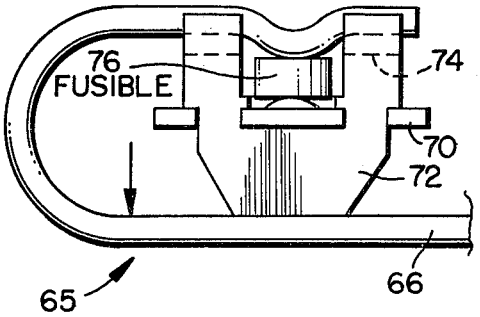
FIG. 3 is a partial elevation on line 3—3 of FIG. 2 with the pellet in position.
Figure 4:
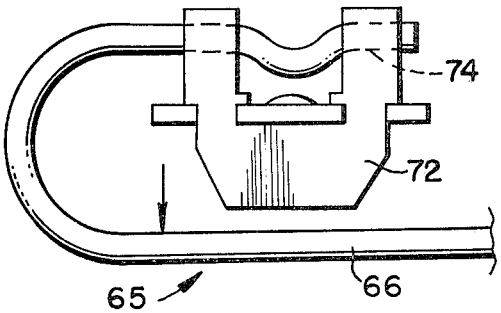
FIG. 4 is a view similar to FIG. 3 with the 10 pellet melted and the bus bar dropped.

In accordance with the invention shown in FIGS. 2–7, an overtemperature control means is provided as an integral part of the thermostat stacked assembly and subject to the same heat as the thermostat to reduce any delay in response. Essentially, the structure moves an overtemperature control of the general concept of U.S. Pat. No. 3,665,152 supra forward to the hottest part of the iron, makes it a pressure connection type, and makes it an integral or unitary part of the adjustable thermostat and forms it for faster and more accurate response to reduce the structural complexity. Two versions are shown, the modification shown in FIGS. 1–4 and an alternate construction shown in FIGS. 5–7. In the first (FIG. 2) modification, the overtemperature control 65 comprises a downwardly biased and horizontally extending conductive bus bar 66 that extends generally parallel and adjacent to the heat deformable blade or bimetal 48 in the stacked assembly and close to it to receive the same heat as the bimetal. The bus bar may extend from a ceramic anchor block 68 in the rear of the iron and through its connection to the anchor block as by bending, the bar is permanently biased downwardly as shown by the arrow in FIG. 2. The bus bar is secured to the conventional one electric terminal 53 in the rear of the iron as a power supply terminal. To connect with the other side of the line at separate terminal 52, the stacked thermostat assembly is provided with a conducting finger 70 that projects from the stacked assembly adjacent to the bus bar and extends substantially at right angles to the bus bar and overlapping it as shown in FIG. 2. The electrical path, when permitted, is into the bus bar and then into projecting finger 70, into the stacked assembly and through electric contacts 60 and on out to separate terminal 52 in the normal manner. This places the conducting finger 70 directly into the bus bar environment, all the structure being in the flat plane of the bimetal and therefore subject to the same heat as the bimetal and responsive immediately with the bimetal. For breaking the circuit on an over temperature condition, a generally U-shaped insulating member 72, that may be ceramic, is disposed between the bar 66 and finger 70 for separating them. The U-shaped insulator permits the use of spaced stop means 74 on each leg to operate as will be explained. To sense a response to an overtemperature condition, a fusible pellet 76 is carried on the insulator 72 and is in series with and between the bar 66 and finger 70, by looping the bar back over the top of the insulator as shown in FIG. 2. Because of its position, the pellet carried by the insulator actually bridges the finger and bar and establishes electrical contact through the pellet as seen in FIGS. 2 and 3. Spaced stops 74 are disposed to limit downward movement of the bar and prevent the bar from contacting finger 70 when the pellet melts on overtemperature at which time the downward bias forces the bar downwardly into the position of FIG. 4 where stops 74 are abutted by the bar to limit its movement. The downward curve of bar 66 contacting the pellet merely provides better electrical contact. The location of the pellet is in close proximity to the deformable bimetal thus responding to the same heat and is in series in the assembly and at the hottest portion of the iron such that as the bar abuts stops 74 it then breaks the circuit between the bar and finger for rapid and accurate heat response. This modification of FIG. 2 permits the electric current to pass directly through the pellet—from the bar through the pellet into the finger—and through the stack such that the pellet is part of the circuit. The particular somewhat E-shape of finger 70 is merely for ease of mounting or clamping insulator 72 thereon as clearly seen in FIG. 2.

Figure 5:
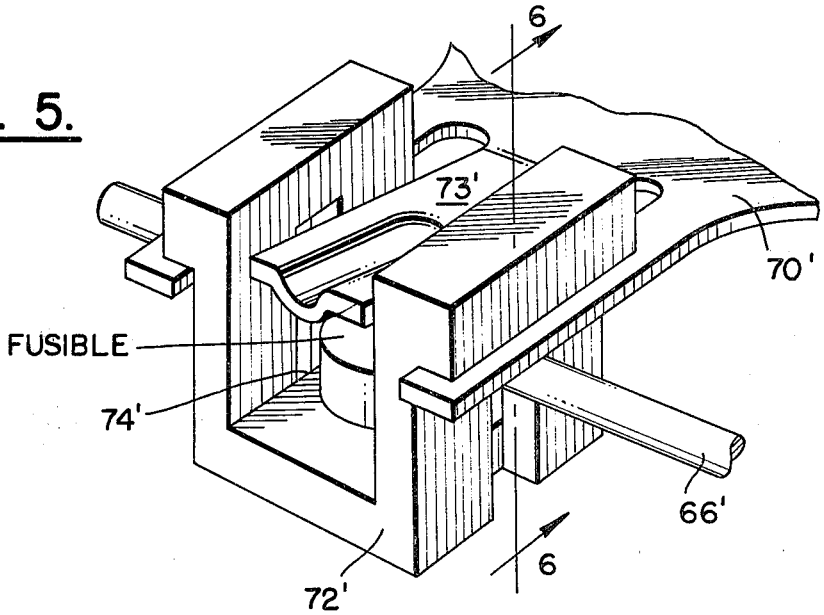
FIG. 5 is an enlarged perspective of a different pellet form of overtemperature control.
Figure 6:
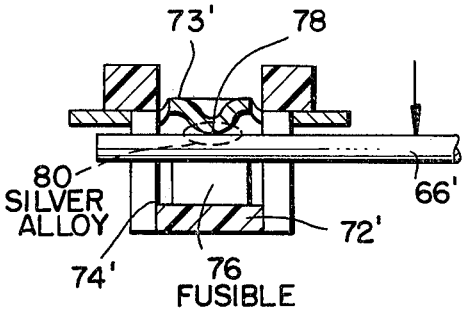
FIGS. 6 and 7 are partial sectionals on line 6—6 of FIG. 5 with the pellet in position and melted breaking the circuit respectively.
Figure 7:
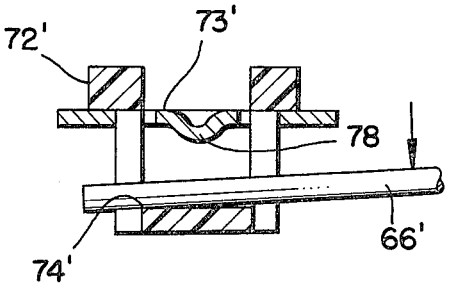

A different modification is shown in FIGS. 5–7 wherein the structure is similar with the bar 66 having its downward bias as before and a comparable conducting E-shaped finger 70' with a slightly different shaped insulator 72' which is between and separates the finger 70' and bar 66 as seen in FIG. 5. In this modification, the central portion 73' of the finger is forced upwardly to provide a downward bias and the pellet 76 in this case is disposed and supported on the insulator below the bar to bias the finger 73' and bar 66 directly against each other to establish an electrical circuit therebetween while the pellet is effectively out of the electrical circuit and the current does not flow through it from the bar 66 to the finger 70' as in the modification of FIG. 2. This has the advantage of removing one of the contact surfaces while still permitting the pellet 76 to be directly in the heated environment and responding rapidly to an overtemperature condition—the difference being the pellet is out of the circuit. Again, the downward motion of the bar 66 is limited by spaced stop means 74' on the legs of insulator 72' as shown in FIG. 7. In this modification, the finger 73' and bar 66 are forced into direct electrical contact at 78 by the bias in finger 73' and the pellet 76 below to reduce one of the contacts and effectively take the pellet 76 out of the electrical circuit. To enhance good contact, a silver alloy may be added in the dotted area 80 if necessary, as shown in FIG. 6.

The operation of both modifications is the same in that on an overtemperature condition caused, for example, by a failure of the thermostat 42, as the temperature of the iron heats up directly over the heating element 18 in the hottest part, the pellet 76 is subjected to the immediate heat, melts, and breaks the circuit by dropping downwardly against stops 74 in FIG. 2 or against stops 74' in FIG. 7.

Thus, both modifications provide a pressure contact overtemperature control that is an integral part of the stacked thermostat assembly and responds to the same heat therethrough for fast and accurate response.

While I have hereinbefore shown preferred forms of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an adjustable stacked thermostat assembly including a lower heat deformable blade, a conductive intermediate stiff spring blade connected to one electric terminal, a conductive upper less stiff spring blade connected to a separate terminal, with all blades supported, secured, and spaced apart at one end by interposed insulators, and electrical contacts on said conductive blades with means transmitting movement between the heat deformable blade to said upper blade to make and break an electric circuit and control heat to a medium sensed by said thermostat, the improvement of an overtemperature control means as part of and adjacent said stacked assembly comprising, a downwardly biased horizontally extending conductive bus bar parallel and adjacent to said heat deformable blade in said assembly and secured to said one electric terminal, a conducting finger connected to said separate terminal through said electrical contacts and projecting from said adjacent stack substantially at right angles to and overlapping the bus bar, an insulator between and separating the finger and bar, a fusible pellet carried by the insulator and cooperating with said finger and said bar to establish an electric circuit therebetween and, stop means on said insulator disposed to limit downward bar movement, whereby on melting of the pellet, the downwardly biased bar drops and abuts said insulator stop means breaking the circuit established between said bar and finger for fast heat response.

2. Apparatus as described in claim 1 wherein said insulator is U-shaped with stop means on each leg of the U, said bus bar spanning the legs, whereby on pellet melting, the downward bar motion is limited by spaced stops.

3. Apparatus as described in claim 2 wherein said pellet is disposed on said insulator in series with and between said bar and finger with the electric current passing through said pellet, whereby the pellet is part of said circuit.

4. Apparatus as described in claim 2 wherein said pellet is disposed on said insulator below and biasing said finger and bar directly against each other whereby the pellet is out of said circuit.

5. Apparatus as described in claim 1 wherein said pellet is disposed on said insulator in series with and between said bar and finger with the electric current passing through said pellet.

6. Apparatus as described in claim 1 wherein said pellet is disposed on said insulator biasing said finger and bar directly in contact with each other.

7. In an electric steam iron having an enclosed water tank in a shell under connected handle structure and a steam generating soleplate with ports for distribution of steam on demand, a pump connected to the tank with a button on the handle for manual pump actuation to deliver water to the soleplate generating means and a mount on the soleplate for close support of a heat responsive thermostat and overtemperature control means in series therewith for thermostatic control of the soleplate temperature, the improvement comprising an adjustable stacked thermostat assembly on said mount including, a lower heat deformable blade, a conductive intermediate stiff spring blade connected to one electric terminal, a conductive upper less stiff spring blade connected to a separate terminal, with all blades supported, secured, and spaced apart at one end by interposed insulators, and electrical contacts on said conductive blades with means transmitting movement between the heat deformable blade to said upper blade to make and break an electric circuit and control heat to said iron soleplate sensed by said thermostat, said overtemperature control means forming part of said stacked assembly and comprising, a downwardly biased horizontally extending conductive bus bar parallel and adjacent to said heat deformable blade in said assembly and secured to said one electric terminal, a conducting finger connected to said separate terminal through said electrical contacts and projecting from said adjacent stack substantially at right angles to and overlapping the bus bar, an insulator between and separating the finger and bar, a fusible pellet carried by the insulator and cooperating with said finger and said bar to establish an electrical circuit therebetween and, stop means on said insulator disposed to limit downward bar movement whereby the pellet responds to the same heat as said deformable blade in series in the assembly so, on melting of the pellet, the downwardly biased bar abuts said insulator stop means breaking the circuit established between said bar and finger for fast response.

8. Apparatus as described in claim 7 wherein said insulator is U-shaped with stop means on each leg of the U, said bar spanning the legs, whereby on pellet melting, downward bar motion is limited by spaced stops.

9. Apparatus as described in claim 8 with said pellet disposed on said insulator in series with and between said bar and finger with the electric current passing through said pellet as part of the circuit.

10. Apparatus as described in claim 8 with said pellet disposed on said insulator below and biasing said finger and bar directly against each other whereby the pellet is out of said circuit.

* * * * *